US008564389B2

(12) United States Patent
Shipley

(10) Patent No.: US 8,564,389 B2
(45) Date of Patent: Oct. 22, 2013

(54) ELECTROMAGNETIC CIRCUIT INTERRUPTER

(75) Inventor: Adrian Shipley, Cheltenham (GB)

(73) Assignee: GE Aviation Systems Limited (GB)

( * ) Notice: Subject to any disclaimer, the term of this patent is extended or adjusted under 35 U.S.C. 154(b) by 0 days.

(21) Appl. No.: 13/100,391

(22) Filed: May 4, 2011

(65) Prior Publication Data

US 2011/0204725 A1 Aug. 25, 2011

(30) Foreign Application Priority Data

May 24, 2010 (GB) ..... 1008607.2

(51) Int. Cl.

| | |
|---|---|
| ***H01H 73/00*** | (2006.01) |
| ***H01H 83/00*** | (2006.01) |
| ***H01H 7/00*** | (2006.01) |
| ***H01H 43/00*** | (2006.01) |
| ***H01H 43/02*** | (2006.01) |
| ***H01H 7/08*** | (2006.01) |
| ***H01H 9/30*** | (2006.01) |

(52) U.S. Cl.

USPC ..... 335/201; 335/28; 335/59; 335/63; 335/64

(58) Field of Classification Search

USPC ..... 335/201, 218, 239, 28, 53, 63, 64

See application file for complete search history.

(56) References Cited

U.S. PATENT DOCUMENTS

| | | | | |
|---|---|---|---|---|
| 2,373,256 | A * | 4/1945 | Miller | 290/38 R |
| 3,659,065 | A | 4/1972 | Roidt et al. | |
| 3,858,017 | A * | 12/1974 | Bertozzi et al. | 200/574 |
| RE29,158 | E * | 3/1977 | Cartier et al. | 200/38 B |
| 4,249,223 | A | 2/1981 | Shuey et al. | |
| 4,490,768 | A | 12/1984 | Mori et al. | |
| 5,004,874 | A | 4/1991 | Theisen et al. | |
| 6,054,846 | A * | 4/2000 | Castleman | 323/283 |
| 7,538,990 | B2 | 5/2009 | Belisle et al. | |
| 2008/0143462 | A1 | 6/2008 | Belisle et al. | |
| 2009/0295314 | A1 * | 12/2009 | Ganev et al. | 318/376 |
| 2009/0295551 | A1 * | 12/2009 | Dickey | 340/310.11 |
| 2010/0013226 | A1 * | 1/2010 | Blumer et al. | 290/44 |

FOREIGN PATENT DOCUMENTS

| | | | |
|---|---|---|---|
| EP | 1939908 | A1 | 7/2008 |
| GB | 1333685 | A | 10/1973 |

OTHER PUBLICATIONS

EP Search Report and Written Opinion issued in connection with corresponding EP Application No. 11166789.5 on Sep. 6, 2011.
GB Search Report dated Sep. 17, 2010.

* cited by examiner

*Primary Examiner* — Alexander Talpalatski
(74) *Attorney, Agent, or Firm* — Global Patent Operation; Marc A. Vivenzio

(57) ABSTRACT

In one aspect, the present invention provides an electromagnetic circuit interrupter for use in a high voltage direct current (DC) aircraft power distribution system. The electromagnetic circuit interrupter comprises a contact mechanism operable to separate first and second electrical contacts by a first predetermined distance $d_1$ for a predetermined time $\tau$ so as to sustain an arc when the contact mechanism is opened. The contact mechanism is further operable to separate the first and second electrical contacts by a second predetermined distance $d_2$ after the predetermined time $\tau$ so as to extinguish the arc. The first predetermined distance $d_1$ is less than said second predetermined distance $d_2$. By deliberately sustaining the arc for a relatively long period of time, this aspect of the present invention is particularly useful for extending the operational lifetime of the contacts and thereby of the electromagnetic circuit interrupter itself.

11 Claims, 3 Drawing Sheets

ELECTROMAGNETIC CIRCUIT INTERRUPTER

FIELD OF INVENTION

The present invention relates generally to an electromagnetic circuit interrupter for a high voltage direct current (DC) aircraft power distribution system.

BACKGROUND OF THE INVENTION

Recent developments in aircraft power distributions have involved a move towards the use of high voltage DC power distribution systems so as to permit a weight reduction for wiring harnesses used to distribute electrical power within an aircraft.

However such high voltage DC systems give rise to additional problems when designing aircraft power distribution systems. The high DC voltages used can, for example, lead to a decreased component lifetime, particularly for electromagnetic switches used to interrupt circuitry from drawing power from the wiring harness. Such switches are preferred to solid state devices because of their higher power ratings and ability to resist the increased switching voltages. However, even these high power devices are not immune to the effects of contact sputtering caused by arcing of the switch contacts provided therein when such contacts are separated in order to break a circuit.

Various devices and techniques have therefore been developed in an attempt to enhance the lifetime of such switchable contacts by mitigating the effects caused by the inductive energy that is stored in the circuit and which causes arcing once the contacts are separated.

For example, various known techniques may employ conventional electromagnetic switches along with additional circuitry that is used to dissipate the inductive energy of the circuit so as to minimise the energy dissipated in the electromagnetic switches themselves [1-3]. Alternatively, various non-conventional electromagnetic switches have been produced which, for example, may seek to confine the physical position of arcs in an attempt to minimise contact erosion [4].

However, whilst such techniques can enhance the useful operational lifetime of electromagnetic switches, there is still a need in the art for high voltage DC electromagnetic circuit interrupters having a further enhanced operational lifetime, particularly when used for safety critical applications such as aircraft power distribution systems.

SUMMARY OF THE INVENTION

The present invention has thus been devised whilst bearing the above-mentioned drawbacks associated with conventional high voltage DC electromagnetic switching devices in mind.

According to one aspect of the present invention, there is thus provided an electromagnetic circuit interrupter for a high voltage DC aircraft power distribution system. The electromagnetic circuit interrupter comprises a contact mechanism operable to separate first and second electrical contacts by a first predetermined distance for a predetermined time so as to sustain an arc when the contact mechanism is opened. The contact mechanism is further operable to separate the first and second electrical contacts by a second predetermined, distance after the predetermined time so as to extinguish the arc. Additionally, the first predetermined distance is less than said second predetermined distance.

Such an electromagnetic circuit interrupter contrasts with conventional devices as it does not seek to open the contacts widely as soon as possible, but rather enables the contacts to be separated for a relatively long time (e.g. several milliseconds compared to prior art devices opening in microseconds) in order that an arc is produced and sustained for a relatively long period. This has the advantage that much of the inductive energy stored in a circuit can be dissipated during the predetermined time period before the contacts of the electromagnetic circuit interrupter become hot enough to melt. Subsequently, the contacts can be further or fully opened to break the circuit, the arc having been extinguished, thereby minimising or substantially eliminating any contact sputtering.

Hence, although the total switching time of the electromagnetic circuit interrupter is increased compared to conventional devices, the operational lifetime and reliability of the contacts can be greatly enhanced.

BRIEF DESCRIPTION OF THE DRAWINGS

Various aspects and embodiments of the present invention will now be described in connection with the accompanying drawings, in which.

DETAILED DESCRIPTION OF THE INVENTION

Figures 1A, 1B, 1C:
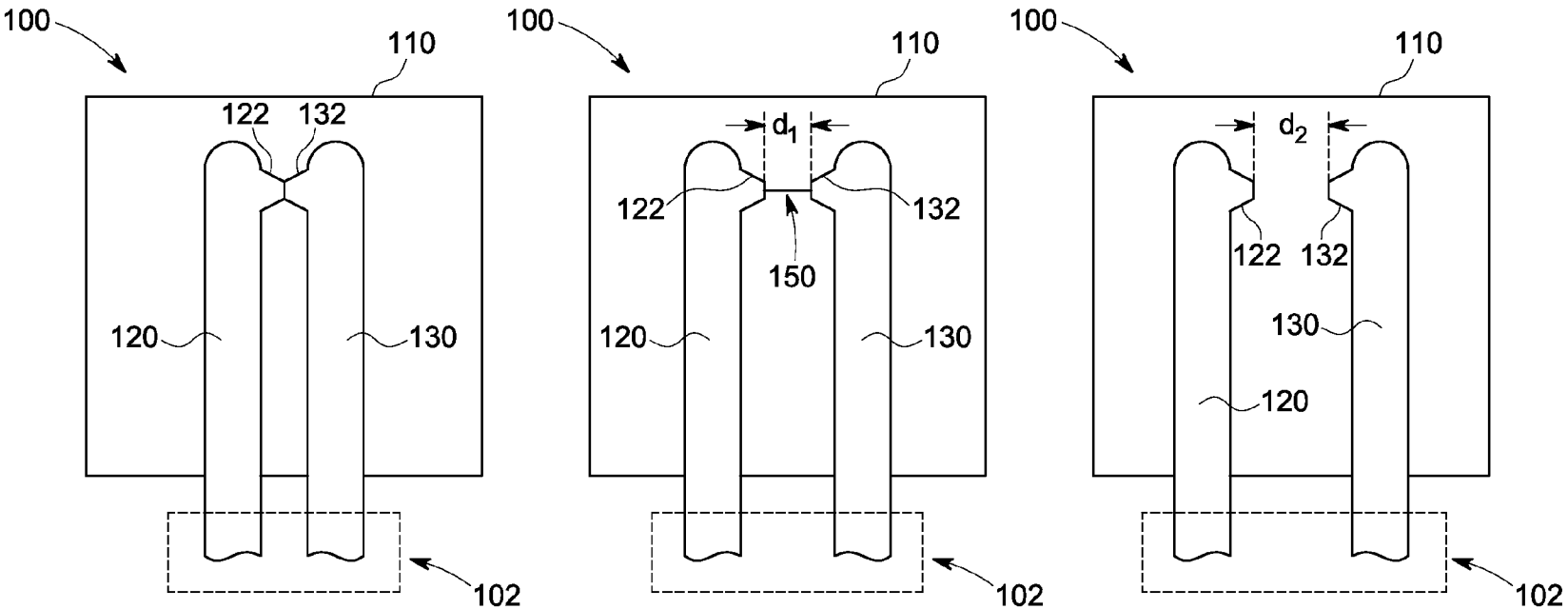
FIG. 1A shows an electromagnetic circuit interrupter for a high voltage direct current (DC) aircraft power distribution system in accordance with various embodiments of the present invention in a closed contact position.
FIG. 1B shows the electromagnetic circuit interrupter of FIG. 1A in an intermediate open contact position.
FIG. 1C shows the electromagnetic circuit interrupter of FIG. 1A in a fully open contact position.

FIG. 1A shows an electromagnetic circuit interrupter 100 for a high voltage direct current (DC) aircraft power distribution system in accordance with various embodiments of the present invention in a closed contact position.

The electromagnetic circuit interrupter 100 comprises a first electrical contact 120 and a second electrical contact 130 hermetically sealed in a housing 110. The first and second electrical contacts 120, 130 are movable within the housing 110 between a closed position, an intermediate open contact position and a fully open contact position by activation of a contact mechanism 102. These three positions are shown respectively in FIGS. 1A-1C. The housing 110 may contain a fill gas. In various embodiments, the fill gas may comprise one or more of: dry air, nitrogen, argon, neon, krypton etc. In various preferred embodiments, nitrogen or another inert gas or gas mixture may be used.

The first electrical contact 120 is formed with an electrically conductive projecting portion 122 which may be made of the same material as the main body of the first electrical contact 120. Alternatively, the projecting portion 122 may be formed of dissimilar material, e.g. metal, from that of the main body of the first electrical contact 120. Similarly, the second electrical contact 130 is formed with an electrically conductive projecting portion 132 which may be made of the same material as the main body of the second electrical contact 130. Alternatively, the projecting portion 132 may be formed of dissimilar material, e.g. metal, from that of the main body of the second electrical contact 130. The surfaces of the projecting portions 122, 132 may be shaped or substantially flat.

In the closed contact position shown in FIG. 1A, the projecting portions 122, 132 abut one another, or fit together depending upon their respective shapes, in order provide a low resistance electrical connection between the first and second electrical contacts 120, 130.

FIG. 1B shows the electromagnetic circuit interrupter 100 in an intermediate open contact position. In the intermediate open contact position the contact mechanism 102 separates the surfaces of the projecting portions 122, 132 by a first predetermined distance $d_1$ for a predetermined time $\tau$. Various methods for determining the first predetermined distance $d_1$ and the predetermined time $\tau$ for embodiments of the invention are discussed further below.

When the first and second electrical contacts 120, 130 are supplied with a high voltage DC potential difference therebetween, an arc 150 is sustained between the projecting portions 122, 132 for a period substantially equal to the whole of the duration of the predetermined time $\tau$. The arc 150 acts like a resistor in the circuit and dissipates stored inductive energy as heat energy causing the temperature of the proximal electrical contacts 120, 130 to rise.

With fast (e.g. of the order of μS) full gap opening of contacts in conventional devices, the arc can heat the contacts up (through resistive $I^2R$ heating). This temperature rise may be enough to cause sputtering and intermittent restriking of the arc until enough inductive energy has been dissipated for this process to cease.

However by selecting the predetermined time $\tau$ and the first predetermined distance $d_1$ to ensure that the temperature rise of the electrical contacts 120, 130 is limited to below the melting temperature of the materials from which they are formed, sputtering can be minimised and operational lifetime of the electromagnetic circuit interrupter 100 increased.

The various parameters chosen depend upon the exact current, voltage and power rating of the electromagnetic switch, the fill gas used, and the contact materials, hence the first predetermined distance $d_1$, the second predetermined distance $d_2$ and the predetermined time $\tau$ vary according to the specific embodiment that is used.

One technique that can be applied to determine whether or not high voltage arcing will occur and/or various of the distance parameters involves finding the Paschen voltage for a particular electromagnetic circuit interrupter 100 embodiment.

For parallel conducting plates, Paschen found that the breakdown voltage $V_b$, (volts) could be described by the equation:

$$V_b = \frac{k_1(P, d)}{\ln(P, d) + k_2} \qquad \text{Equation 1}$$

where P is the pressure of the gas between the two plates, d the separation distance between the two plates and $k_1$ and $k_2$ are constants dependant upon the specific gas or gas mixture used.

Differentiating Equation 1 and setting the derivative to zero, gives:

$$P \cdot d = e^{(1-k_2)} \qquad \text{Equation 2}$$

which in turn enables the Paschen voltage $V_P = V_{bmin}$ to found from Equation 1.

For example, for a high voltage application and so as to ensure arcing does actually occur, the operating high DC voltage of the electromagnetic circuit interrupter 100 must be greater than the Paschen voltage $V_P$ for any particular gas and at any given temperature. For contacts in air at standard atmospheric pressure, for example, the following parameters may be selected: 1.5 mm$<d_1<$2.5 mm with $d_2$, for example, set such that $d_2 \approx 3$ mm.

FIG. 1C shows the electromagnetic circuit interrupter 100 in a fully open contact position. In the fully open contact position the contact mechanism 102 separates the surfaces of the projecting portions 122, 132 by a second predetermined distance $d_2$(where $d_2>d_1$) until such a time as the electromagnetic circuit interrupter 100 is switched back to the closed contact position. When switching back from the fully open contact position to the closed contact position, the contact mechanism 102 rapidly and directly moves the first and second electrical contacts 120, 130 together without any intermediate contact separation stages.

As the first and second electrical contacts 120, 130 are fully opened from the intermediate open contact position, any arc 150 is rapidly extinguished. Additionally, since much of the stored inductive energy will already have been dissipated at this time, the arc 150 is highly unlikely to restrike and cause damage to the first and second electrical contacts 120, 130 or the projecting portions 122, 132.

In various embodiments, the contact mechanism 102 may include one or more solenoid actuators and/or mechanical arrangements for moving the first and second electrical contacts 120, 130 between the closed position, the intermediate open contact position and the fully open contact position. Various such embodiments would be readily envisaged by those skilled in the art of mechanical actuator design.

Figure 2:
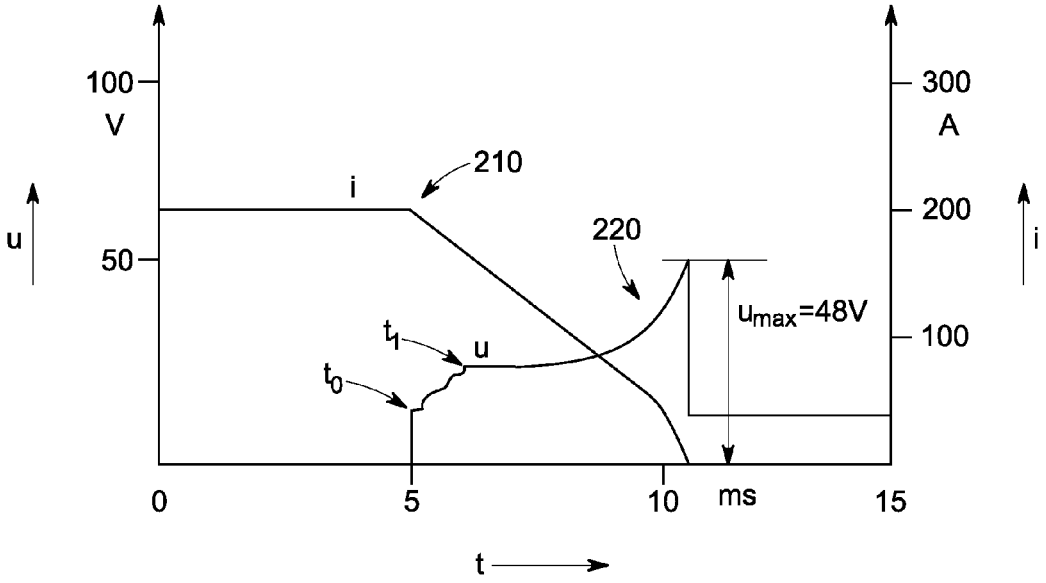
FIG. 2 shows temporal I-V curves for a low voltage DC circuit interruption.

FIG. 2 shows temporal I-V curves for a low voltage DC circuit interruption. The temporal I-V curves include a graphical depiction of a current (I) profile 210 and a graphical depiction of a voltage (V) profile 220 for a low voltage DC circuit interruption.

At time t=5 mS, the circuit is interrupted and the current profile 210 shows a steady decrease in the circuit current from about 200 Amps to about 40 Amps over a period of about 5 mS as the stored inductive energy dissipates as heat. A rapid current decrease to zero Amps is observed after about t=10 mS with the current dropping rapidly from about 40 Amps to zero during an interval of about 1 mS.

The voltage profile 220 shows how the potential between the contact electrodes varies over time. At $t_0$, in this case equal to t=5 mS, circuit interruption begins and a potential of about 15 volts rapidly develops across the contact electrodes. At $t_0$, the force holding the metallic electrodes together is reduced. This in turn increases the contact resistance resulting in increased heat. As the contact force is further reduced, the area over which current flows is reduced also increasing the contact temperature further. At the extreme limit, all of the circuit current passes through an infinitesimal surface area resulting in this area of the electrode melting and a controlled explosion occurs.

Metal vapour or particles thus sputter from the contact electrodes, and between $t_0$ and $t_1$ (about 1 mS later) conduction through metalised air occurs. At $t_1$ the electrode gap becomes vacuous in nature and a vacuum arc develops. The voltage profile of the vacuum arc follows the exponential curve shown increasing initially from about 15-20 volts at $t_1$ to about 48 volts at a time when the current profile 210 reaches zero Amps. During this time period, i.e. from about t=6 mS to about t=11 mS, the inductive energy $$E = \left(\frac{1}{2}LI^2\right)$$

stored in the circuit is converted to heat within the are and some is also dissipated by the load connected to the circuit interrupter.

Figure 3:
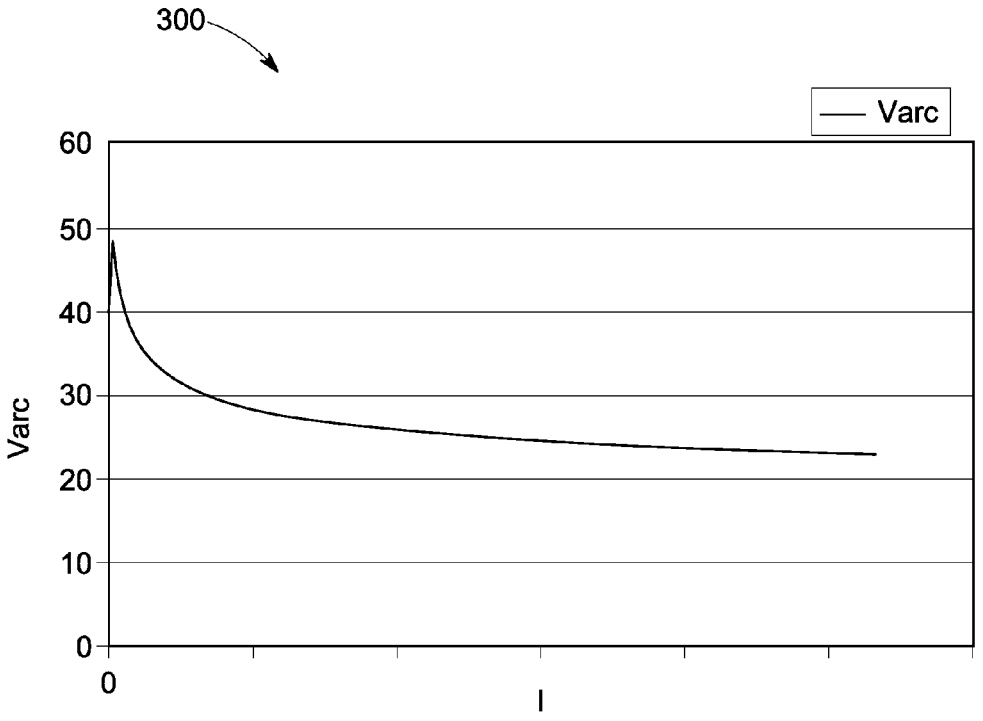
FIG. 3 shows an I-V characteristic graph for a low voltage arc.

FIG. 3 shows an I-V characteristic graph 300 for the low voltage arc produced in FIG. 2. The fill gas is nitrogen. FIG. 3 shows that as the current in a circuit that is being interrupted reduces, the arc voltage rises (negative impedance). Once the current is reduced to zero the arc voltage also reduces to zero volts.

The arc voltage is also related to the gap over which the arc must traverse. If higher voltages are available and the circuit has enough energy stored, the arc may be drawn and higher arc voltages are observed.

Figure 4:
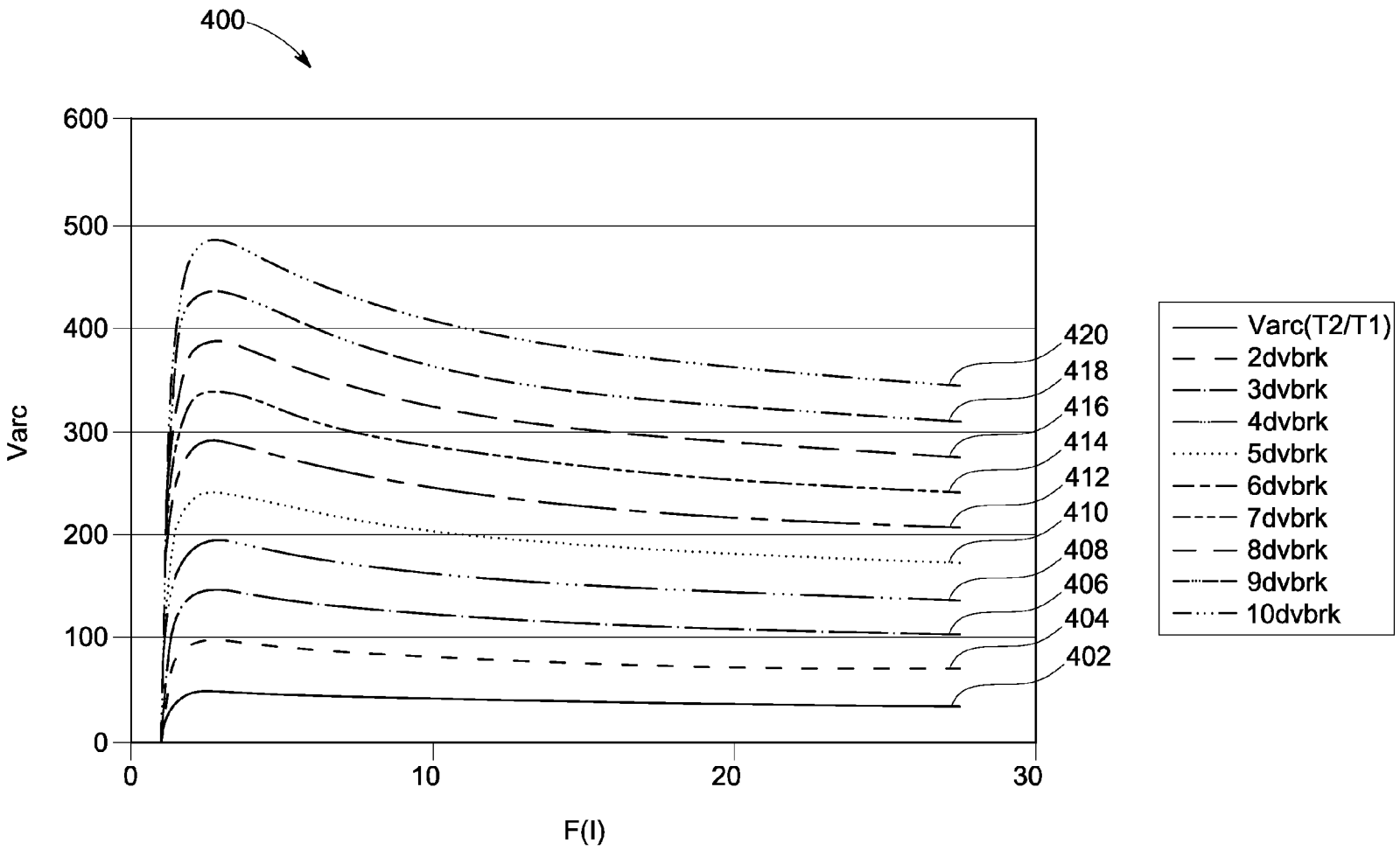
FIG. 4 shows various high voltage arc voltage waveforms provided by operating various embodiments of the present invention.

FIG. 4 shows various high voltage arc voltage waveforms 402 to 420 provided by operating various embodiments of the present invention. Voltage waveform 402 is substantially equivalent to the low voltage arc profile as per FIG. 3, described above.

The y-axis ($V_{arc}$) is calibrated in volts. However, $V_{arc}$ is also indicative of the temperature of the arc ($T_2$) relative to ambient temperature ($T_1$), such that $$V_{arc} \alpha \frac{T_2}{T_1}.$$

The x-axis (F(I)) is a function of the current flowing in the arc.

A predetermined time $\tau$ may thus be determined such that $T_{arc} < T_{meltmin}$, where $T_{arc}$ is the temperature generated by the arc and $T_{meltmin}$ the lowest melting temperature of the materials from which the first and second electrical contacts are made. For example, $\tau$ may be determined such that $$T_{arc} << T_{meltmin}, \text{ e.g. } T_{arc} = \frac{T_{meltmin}}{\alpha},$$

where $\alpha$=2, 5, 10, 20, etc. to minimise contact sputtering and may be from about 1 mS to about 10 mS, for example.

An array of arc voltage waveforms possible in a circuit with higher voltages available is shown in FIG. 4. The second voltage waveform 404 has a profile equivalent to twice that of the low voltage arc profile of voltage waveform 402. The third voltage waveform 406 has a profile equivalent to three times that of the low voltage arc profile of voltage waveform 402. The fourth voltage waveform 408 has a profile equivalent to four times that of the low voltage arc profile of voltage waveform 402. The fifth voltage waveform 410 has a profile equivalent to five times that of the low voltage arc profile of voltage waveform 402. The sixth voltage waveform 412 has a profile equivalent to six times that of the low voltage arc profile of voltage waveform 402. The seventh voltage waveform 414 has a profile equivalent to seven times that of the low voltage arc profile of voltage waveform 402. The eighth voltage waveform 416 has a profile equivalent to eight times that of the low voltage arc profile of voltage waveform 402. The ninth voltage waveform 418 has a profile equivalent to nine times that of the low voltage arc profile of voltage waveform 402. The tenth voltage waveform 420 has a profile equivalent to ten times that of the low voltage arc profile of voltage waveform 402.

Each of the voltage waveform curves 402-420 is related to a given arc gap. The voltage is directly proportional to the gap size. Therefore for a higher voltage arc to be realised a greater gap size must be provided. For example, the first predetermined distance $d_1$ may be defined as: $d_1 = m\lambda$, where m is a predetermined factor representing a number of mean free paths that make up the distance d between the first and second electrical contacts and $\lambda$ is a DC low voltage arc gap substantially equal to one electron mean free path between first and second electrical contacts. The second predetermined distance $d_2$ may then be equal to a conventional gap distance for an equivalently rated conventional electromagnetic circuit breaker.

The mean free path $\lambda$ may be defined such that:

$$\lambda = \frac{kT}{p\sigma} \qquad \text{Equation 3}$$

k being Boltzmann's constant, T being the arc temperature (e.g. 15,000 Kelvin), p the pressure of the gas between the contacts, and $\sigma$ gas specific cross sectional area.

In one embodiment, to interrupt a 270 volt circuit the following three stage process may be used in order to allow the circuit's inductive energy to be dissipated and prevent unwanted arc draw:

1. Open the contacts to a distance about six to seven times the gap required for the low voltage arc 402 (e.g. m may lie in the range from about 6 to about 7). This provides an operating range for F(I) from about 8 to about 20 when $V_{arc}$=270 volts, as can be seen in FIG. 4, and ensures an arc is sustained whilst also constraining the temperature rise of the contacts (proportional to $V_{arc}$) to below the peak values seen for the curves 412 and 414;
2. Hold the contacts for a period of time $\tau$ for a given energy interruption capability, or until the current reaches zero Amps; and
3. Open the contacts further to provide a dielectric withstand capability.

For example, using Equation 3 with p=101321 Pa; T=6000 K, and $\sigma = \pi r_i^2$ where $r_i$ is the ionic radius for Nitrogen=30 nm, $\lambda$ can be found. Multiples of $\lambda$ can then be used to define the contact separation distances required. The contact predetermined opening time may be calculated by determining the time needed to dissipate an amount of energy $\Delta E$, such that $\Delta E = V_{arc} \cdot I \cdot t$, according to a specific device rating.

The predetermined time $\tau$ may thus be chosen such that the inductive energy remaining in the circuit when the contacts are opened is not sufficient to increase the voltage across the contacts enough to enable the arc to restrike. An additional safety factor may be used such that $E_{stored}(\tau) < E_{rearc}$, e.g. $\tau$ is chosen such that $$E_{stored}(\tau) = \frac{E_{rearc}}{\beta},$$

where $E_{stored}(t)$ is the amount of inductive energy remaining in the circuit at a time t after the contacts are separated and the circuit broken at time t=0, $E_{rearc}$ the energy needed to cause the arc to restrike when the first and second electrical contacts are separated by the first predetermined distance $d_1$, and $\beta$ a safety factor greater than one (e.g. $\beta$=2).

Adopting such a release technique helps prevent the possibility of the arc re-striking should it be prematurely terminated. This contrasts with conventional devices in which if the metallic contacts are opened too fast, and the energy in the system is unable to sustain the original arc temperature, the arc quenches and current stops flowing. The still stored inductive energy in the system then increases the voltage across the contact gap until there is sufficient voltage available for breakdown to occur and thus re-strike the arc.

For example, in various embodiments of the present invention, the predetermined time $\tau$ may be from about 1 mS to about 15 mS, or more preferably from about 5 mS to about 8 in mS. In contrast, conventional electromagnetic devices often open contacts to break a circuit over a time period that is several orders of magnitude faster than such embodiments, e.g. of the order of microseconds or tens of microseconds.

Whilst various aspects and embodiments of the present invention have been described herein, those skilled in the art will also realise many embodiments of electromagnetic circuit interrupters falling within the scope of the claims may be made. Additionally, they will be aware that various techniques, both experimental and theoretical, may be used to determine certain operating parameters for such electromagnetic circuit interrupters, for example, in order to determine a first predetermined opening distance, a predetermined intermediate contact opening time and/or a second predetermined opening distance. Moreover, many versions of possible contact mechanism embodiments will also be apparent.

REFERENCES

1. GB 1 333 685 (Hughes)
2. U.S. Pat. No. 4,249,223 (Shuey)
3. US 2008/0143462 (Belisle)
4. U.S. Pat. No. 5,004,874 (Theisen)

Where permitted, the content of the above-mentioned references are hereby also incorporated, into this application by reference in their entirety.

What is claimed is:

1. An electromagnetic circuit interrupter for a high voltage direct current (DC) aircraft power distribution system, comprising:

a single pole contact device comprising a first electrical contact and a second electrical contact, wherein each of the first contact and the second contact is movable;

a contact mechanism coupled to each of the first contact and the second contact and configured to move each of the first contact and the second contact to separate the first and second electrical contacts by a first predetermined distance for a predetermined time so as to sustain an arc between the first and second electrical contacts;

wherein the contact mechanism is further configured to move the first contact and the second contact to separate the first and second electrical contacts by a second predetermined distance after the predetermined time so as to extinguish the arc;

wherein the contact mechanism is further configured to move the first contact and the second contact together to directly reconnect the first and second electrical contacts without any intermediate contact separation stages; and wherein said first predetermined distance is less than said second predetermined distance.

2. The electromagnetic circuit interrupter of claim 1, wherein the first predetermined distance is defined as: $d_1=m\cdot\lambda$ where m is a predetermined factor and $\lambda$ a DC low voltage arc gap equal to one electron mean free path between the first and second electrical contacts.

3. The electromagnetic circuit interrupter of claim 1, wherein the second predetermined distance is equal to a conventional gap distance for an equivalently rated conventional electromagnetic circuit breaker.

4. The electromagnetic circuit interrupter of claim 1, wherein the predetermined time is determined such that $T_{arc}<T_{meltmin}$ where $T_{arc}$ is the temperature generated by the arc and $T_{meltmin}$ the lowest melting temperature of the materials from which the first and second electrical contacts are made.

5. The electromagnetic circuit interrupter of claim 1, wherein the predetermined time is from about 1 mS to about 15 mS.

6. The electromagnetic circuit interrupter of claim 5, wherein the predetermined time is from about 5 mS to about 8 mS.

7. A high voltage DC power supply system for an aircraft, comprising:

a wiring harness for distributing electrical power within an airframe;

at least one electrical load electrically connected to said wiring harness;

a high voltage DC power supply electrically connected to said wiring harness;

an electromagnetic circuit interrupter electrically connected between said wiring harness and a respective electrical load, the electromagnetic circuit interrupter being operable to disconnect the respective electrical load from the wiring harness, the electromagnet circuit interrupter comprising:

a single pole contact device comprising a first electrical contact and a second electrical contact, wherein each of the first contact and the second contact is movable;

a contact mechanism coupled to each of the first contact and the second contact and configured to move the first contact and the second contact to separate the first and second electrical contacts by a first predetermined distance for a predetermined time so as to sustain an arc between the first and second electrical contacts;

wherein the contact mechanism is further configured to move the first contact and the second contact to separate the first and second electrical contacts by a second predetermined distance after the predetermined time so as to extinguish the arc;

wherein the contact mechanism is further configured to move the first contact and the second contact together to directly reconnect the first and second electrical contacts without any intermediate contact separation stages; and wherein said first predetermined distance is less than said second predetermined distance.

8. The high voltage DC power supply system of claim 7, wherein the high voltage DC power supply operates at a voltage greater than the Paschen voltage of the electromagnetic circuit interrupter.

9. A method of operating an electromagnetic circuit interrupter having a single pole contact device comprising first and second electrical contacts separable by operating a contact mechanism, wherein each of the first contact and the second contact is movable the method comprising:

moving the first contact and the second contact using the contact mechanism to separate the first electrical contact and the second electrical contact by a first predetermined distance for a predetermined time so as to sustain an arc when the contact mechanism is opened;

moving the first electrical contact and the second electrical contact using the contact mechanism to separate the first electrical contact and the second electrical contact by a second predetermined distance after the predetermined time so as to extinguish the arc, said first predetermined distance being less than said second predetermined distance; and moving the first electrical contact and the second electrical contact using the contact mechanism to directly reconnect the first and second electrical contacts without any intermediate contact separation stages.

10. The method of claim 9, wherein the predetermined time is from about 1 mS to about 15 mS.

11. The method of claim 10, wherein the predetermined time is from about 5 mS to about 8 mS.

* * * * *

UNITED STATES PATENT AND TRADEMARK OFFICE

CERTIFICATE OF CORRECTION

PATENT NO. : 8,564,389 B2
APPLICATION NO. : 13/100391
DATED : October 22, 2013
INVENTOR(S) : Shipley It is certified that error appears in the above-identified patent and that said Letters Patent is hereby corrected as shown below:

In the Specification

In Column 1, Line 64, delete "predetermined," and insert -- predetermined --, therefor.

In Column 3, Line 50, delete "$V_b$," and insert -- $V_b$ --, therefor.

In Column 5, Line 5, delete "are" and insert -- arc --, therefor.

In Column 7, Line 11, delete "in mS." and insert -- mS. --, therefor.

Signed and Sealed this
Fourth Day of March, 2014

Michelle K. Lee

Michelle K. Lee
*Deputy Director of the United States Patent and Trademark Office*